US009732393B2

(12) United States Patent
de Souza Lima Guerra

(10) Patent No.: US 9,732,393 B2
(45) Date of Patent: Aug. 15, 2017

(54) BLOWING SPEAR FOR FABRICATION OF METALS AND MAINTENANCE OF LOADING AND BLOWING OPERATIONAL CONDITIONS

(71) Applicant: Lumar Metals Ltda., Santana do Paraiso (MG)

(72) Inventor: Marcelo de Souza Lima Guerra, Ipatinga (MG)

(73) Assignee: LUMAR METALS LTDA., Santana do Paraiso (MG)

( * ) Notice: Subject to any disclaimer, the term of this patent is extended or adjusted under 35 U.S.C. 154(b) by 259 days.

(21) Appl. No.: 14/414,022

(22) PCT Filed: Jul. 8, 2013

(86) PCT No.: PCT/IB2013/055590
§ 371 (c)(1),
(2) Date: Jan. 9, 2015

(87) PCT Pub. No.: WO2014/009870
PCT Pub. Date: Jan. 16, 2014

(65) Prior Publication Data

US 2015/0259762 A1 Sep. 17, 2015

(30) Foreign Application Priority Data

Jul. 10, 2012 (BR) ..... 102012016961

(51) Int. Cl.
*C21C 5/00* (2006.01)
*C21C 5/46* (2006.01)

(52) U.S. Cl.
CPC ..... *C21C 5/4606* (2013.01); *C21C 5/4613* (2013.01); *C21C 2005/4626* (2013.01)

(58) Field of Classification Search
CPC ..... C21C 5/4606
(Continued)

(56) References Cited

U.S. PATENT DOCUMENTS 3,833,209 A 9/1974 Chang
4,057,421 A * 11/1977 Fukui ..... C21C 5/4606 75/512
2009/0189322 A1* 7/2009 Strelbisky ..... C21C 5/30 266/44

FOREIGN PATENT DOCUMENTS

GB 1009327 A 11/1965
WO 92/07965 A1 5/1992

OTHER PUBLICATIONS

International Search Report and Written Opinion for PCT/IB2013/055590.

* cited by examiner

*Primary Examiner* — Scott Kastler
(74) *Attorney, Agent, or Firm* — McClure, Qualey & Rodack, LLP

(57) ABSTRACT

The current invention refers to a blowing spear (100) used in the primary refining process for obtainment of steel, developed in such a way to maintain the loading and blowing operational conditions, comprising at the base a copper nozzle (101) to which is welded in its extremity a tube (102), comprising yet a module (125) with cleaning output (103) and positioned above module (125) a steel tube (118) and on its upper extremity, the head (107) that comprises a cooling liquid inlet (115), a gases inlet (116) and a cooling liquid outlet (117), comprising yet the spear (100) in its interior the inner tube (122) responsible for the gas passage and the intermediate tube (123) responsible for the division between the cooling liquid inlet flow and its outlet passing mandatorily through the copper nozzle (101).

6 Claims, 2 Drawing Sheets

Figure 1:
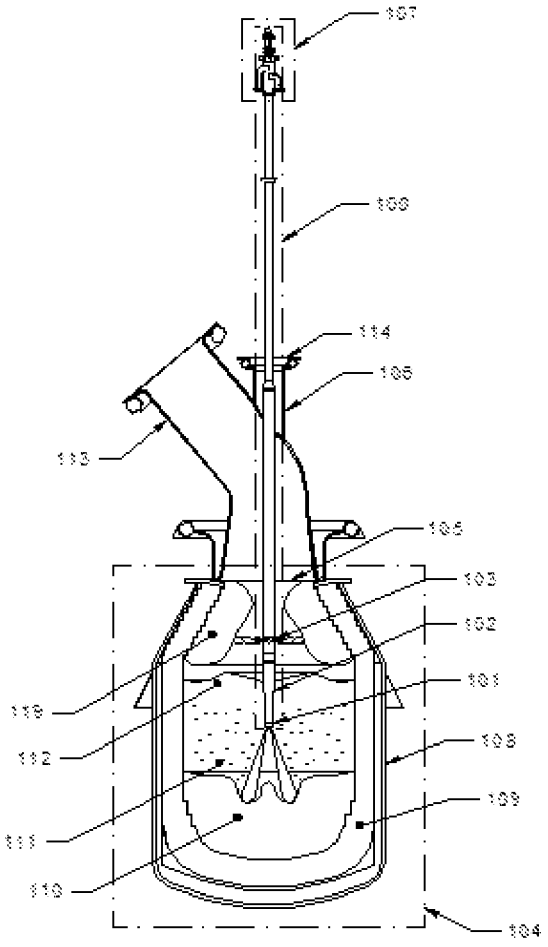

(58) Field of Classification Search
USPC ..... 266/225
See application file for complete search history.

BLOWING SPEAR FOR FABRICATION OF METALS AND MAINTENANCE OF LOADING AND BLOWING OPERATIONAL CONDITIONS

The current invention refers to a blowing spear used in metal fabrication processes, more specifically to a spear used in the process named "primary refining" for obtainment of steel, developed in such a way to maintain the loading and blowing operational conditions.

STATE OF ART

Blowing spears are largely used in the metallurgical industry for injection of gases, primarily the oxygen, in the metallic bath, when in the process of obtaining liquid metals. One can notice that besides oxygen, these spears may also be used for injection of other gases or mixture of gases in the fabrication processes of liquid metals.

The steel fabrication process utilizes ovens that are at elevated temperatures and the injection of gases promotes the purification of metals for the activities to which they are destined for. The combustible introduction, notedly the oxygen, is performed by means of a blowing spear introduced inside the oven with the objective of coming closer to the bath surface to accelerate the reactions speed, thus staying submitted to elevated temperatures. For its turn, the gas injection process arouses the liquid metal agitation that is launched upwards being able to solidify either at the spear's surface, as at the oven's walls, as well as being thrown outside the oven.

For obtainment of a blowing spear with a greater lifetime, once it is submitted to elevated temperatures, which reduces its lifetime, it is necessary that it is refrigerated, as for instance, in this case, through water circulation. The temperature at the spear's external face is elevated and highly superior to water's boiling heat. In the case that the processed metal is steel, the temperature surpasses 1,700° C., and in some cases, it may occur that the spear is immersed in the emulsion core, a mixture composed by a metallic bath, combustion gases, combustible gases and slag, which is the liquid sub-product of the metallic bath's refining.

For this reason, normally the state of art's oxygen blowing spears have an internal cooling system to maintain the spear's body temperature lower enough to support the refining conditions without occurring the softening and even melting of its components. The cooling liquid normally employed is water that circulates at the spear using pumps. Thus, the cooling system performs a thermal exchange between the spear's body, generally made of steel, and the liquid metal processing in the oven, through the water that circulates inside it. The water circulation may suffer alterations with the objective of increasing its boiling point. Because the melting point of steel, material from which the spear is normally fabricated, is relatively high, this confers to the spear's body a good resistance at high temperatures.

The spear's bottom extremity, named nozzle, is normally manufactured in copper, as this metal has a high coefficient of thermal transmission, causing the heat that arrives at its surface to be immediately transferred to the cooling liquid. Although the low melting point of copper, the effectiveness of the thermal exchange with the cooling liquid impedes its fusion at the elevated temperatures of the steel fabrication process.

The liquid bath in processing at the oven is divided into two distinct volumes, being one part of slag, of lesser density, resultant of this process of metal purification, and the refined metallic material, steel in this case, with higher density. Due to the difference of densities, the tendency is the liquid steel to deposit at the bottom and slag remaining supernatant when blowing is interrupted. During blowing, there are projections (splashes and spitting) of slag and steel over the spear-body's surface. Thus, when colliding against the spear-body's surface, the material suffers the thermal exchange effects and how the limits are lower than the solidification temperatures of metal and slag, either the metal residue as the slag remain adhered to the spear's external surface. At every blowing cycle, the thickness of this material increases, gradually forming a material accumulation known as "Dross". "Dross" is a solidified mixture of steel, slag and other elements in lesser quantity.

Also, the "dross" continues to adhere on the upper regions of the oven, normally colder due to the contact distance with oxygen blowing. In this case, it may occur, as a consequence of dross formation, the gradual closing of the region known as oven's "mouth", making it difficult the loading of raw-materials before the process starts, and, in some extreme cases, the dislocation of the ovens' gravity center. For comprehension, the ovens have a system that permits that they are tilted or rotated into positions out of vertical facilitating the operations of raw-material loading, notedly liquid pig iron and scrap iron, as well as performing the leakage operations of liquid metal, steel and slag.

The oven's "mouth" is the region with a cone trunk shape at the upper region. The gradual closure by dross accumulation reduces its passage area and this brings negative implications to process times. During the scrap loading, it increases the possibility of occur the "caging" or accumulation of scrap in the oven's "mouth" due to the difficulty of its putting in the oven. In order to resolve this problem, successive maneuvers are necessary with the rolling bridge, resulting in losses in the process time. During the liquid pig iron loading, the mouth closing causes leakage of liquid material outside the oven, resulting in increasing of metallic loss or metallic yield of the process. These delays and losses compromise the steel daily production, and must be avoided, once production costs rise with equipment idleness and metallic material losses.

In the case of dross occurring on the spears, the common practice is the replacement for another spear duly cleaned and prepared, while the spear with dross is under maintenance. This necessarily requires the existence of a stock of spare spears, which represents elevation of production costs.

For cleaning the oven's mouth the traditional practice requires the complete stoppage of the production process so that the oven can be tilted until one position that permits the utilization of mechanical "battering rams" or manual oxy-acetylene cutting for material removal (dross). This oven stoppage practice compromises substantially the ovens' daily production. Recently, in order to reduce the production losses, copper nozzles were developed to be used for the specific purpose of cleaning the "mouth". These spears are designed in such a way that the oxygen flow is aimed horizontally. The holes are arranged around the entire nozzle, with the objective of hitting the whole "mouth" circumference. To maximize the cleaning, the spear is moved from the most external region of the "mouth" to the region of steel leakage channel, thus executing cycles between these two extremes. Despite the easiness and gains of this practice, it still does not have significance on the daily volumes produced because although being a practice that reduces the mouth cleaning time, still is necessary to stop the production cycle in order to execute this task. It is a common request to obtain a spear that executes the refining functions without the formation of dross either on the spear's body as on the oven's body as.

A spear with cooling system of the state of art may be observed at the North American U.S. Pat. No. 5,350,158. The referring spear employs several concentric tubes of distinct diameters, which form a cooling system internal to the spear. A cooling fluid circulates inside the referred tubes in such a way to absorb the heat. In order to increase this thermal exchange, internal fins are used, which are in contact with the external wall of an internal tube and the cooling fluid properly said. However, such device still presents the adherence of "dross" in its external surface when using the spear, as its surface does not present the necessary characteristics to avoid the fusion or fall of the material that may hit it.

The North American U.S. Pat. No. 6,440,356, U.S. Pat. No. 6,673,305 and U.S. Pat. No. 6,773,659 present a similar cooling system, having concentric steel tubes that permit the heat exchange. In the above-mentioned documents, no type of internal fin is described to help the heat transfer between the cooling fluid and the spear's body. It is described an internal spiral that helps the distribution of the air/combustible supplied to the metal obtainment process, circulating inside this spiral the cooling fluid. The North American U.S. Pat. No. 6,673,305 and U.S. Pat. No. 6,773,659 describe a spear presenting the lower end in copper.

INVENTION SUMMARY

The invention herein refers to a blowing spear for metals fabrication. This spear is comprised by a set of concentric circular tubes, normally manufactured in steel, having in its upper part a place for gases inlet and inlet and outlet of the cooling liquid. In its lower part, it has outlets for the gases that will be injected in the bath.

The format of the spear's lower part is conical and manufactured in copper, which facilitates the detachment of the adhered "dross". Yet, inside this conical lower part, fins are arranged in a spiral form, whose primary function is increasing the thermal-exchange efficiency between the tube walls and the cooling liquid.

Between the upper and lower part, there are gases outlets distributed along the external tube circumference, at a certain length, with varied angles and dimensions. Depending on the oven's dimensions, in different lengths of the spear it is possible to place more sets of gases outlets. The function of these gases outlets is avoiding the adherence formation of "dross" either in the oven's mouth region as in the tube region above those outlets. Through these outlets of combustible gas, the oxygen reacts with the metal primary refining gas, rich in carbon monoxide. This reaction is known as post-combustion and generates heat, increasing the temperature at the "mouth" region, and at the spear's lower part, making it difficult the adherence of the refining material that maintains liquid and returns to the emulsion's core.

FIGURES

The current invention will be meticulously described below based on an execution example represented at the figures listed as follows:

FIG. 1—it is a cut overview of the spear at operation position in the oven.

Figure 2:
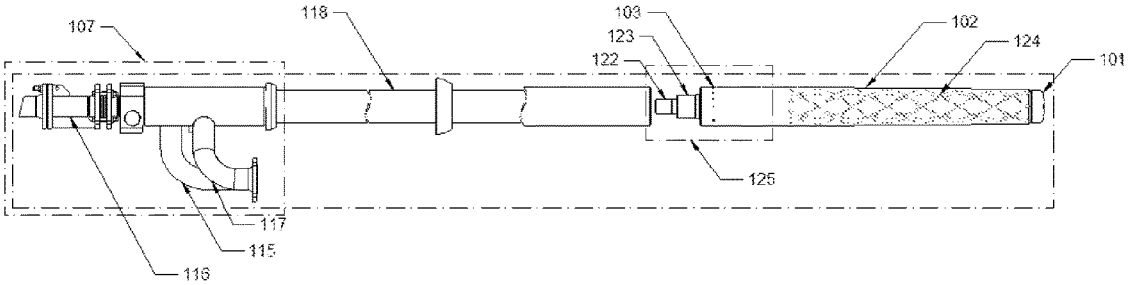

FIG. 2—it is a cut overview of the spear

Figure 3:
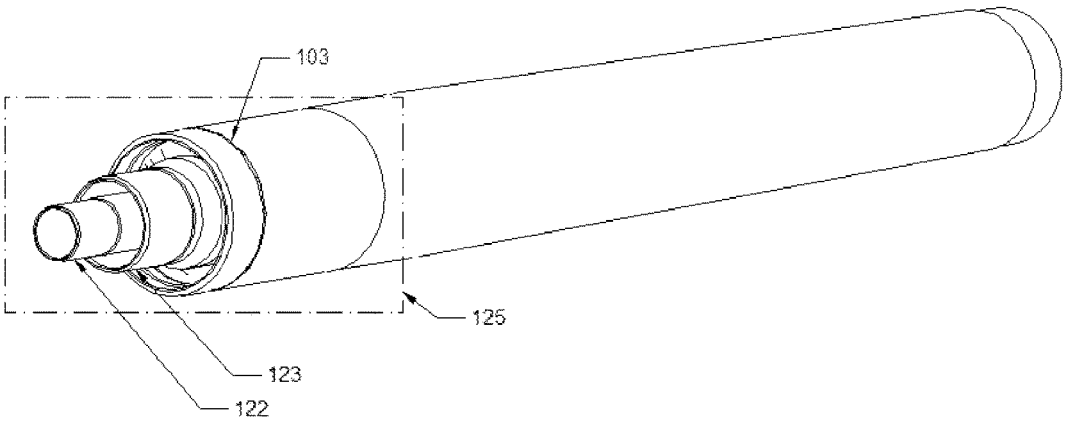

FIG. 3—it is a top overview of the spear's outlets set destined for cleaning the "mouth" and top part cleaning maintenance;

DETAILED DESCRIPTION OF FIGURES

FIG. 1 presents the overview of spear set (100) positioned inside a steel production oven. This set is comprised by a copper nozzle (101), which has in its extremity the oxygen outlets in a varied number of holes quantity, and the conical tube (102) having internal fins in copper. The conical tube's length (102), as well as its conicity is a function of the products and processes characteristics of each oven. In a general way, the more the oven's capacity, the greater will be the conical region's length, as it implicates in the positioning of the outlets that will perform the spear's cleaning at the oven's upper part and "mouth". The conicity is dimensioned in function of the slag volumes, being in a general way, the more the slag volume, the lesser the spear's conicity. Above the conical tube (102), it is situated the set of cleaning gases outlets (103), whose quantities and dimensions vary, depending on the process needs, in relation to the mouth's cleaning (105) or cleaning of the spear's cylindrical upper part (106) or both, or yet, of the oven's dimensions (104). The size of the cleaning gases outlets may vary from sonic speeds to supersonic speeds, being the sonic speed for post-combustion at short distances, maintaining the spear's upper part in higher temperatures, and the supersonic speed for post-combustion at long distances, maintaining the oven's "mouth" region heated, avoiding the "dross" adherence. The oven's dimensions determine the quantity of outlets, as the adequate distribution promotes a homogeneous cleaning at the "mouth" circumference. Above the cleaning outlets (103), it is located the spear's cylindrical upper part (106), in steel. At the upper extremity, there is the spear's head (107), which purpose is promoting the inlet of gases and inlet and outlet of the cooling liquid.

Yet, in FIG. 1, it is presented a metallurgy oven (104), which have a metallic external wall named carcass (108), forming a container opened at the upper part, the oven's mouth (105). The metallurgy oven is coated internally with a refractory wall (109) with the objective of maintaining the liquid metal at the temperatures developed in the process.

During the steel fabrication process, the oven's interior (104) is invaded by three phases mixed by the agitation caused by the copper nozzle holes (101). The phases are: liquid metal or bath (110), slag (111) and gases (112). The projections of these elements at the wall situated at the oven's "mouth" region (105), when solidified, form what we call dross (119).

At the upper part of the oven (104), a de-dusting duct (113) is installed with a side opening (114) that permits the entering movement of the spear (100) routing inside the oven (104) and its removal at the end of the processed batch.

In the position of bath processing (110) inside the oven (104), the spear needs to be advanced at an appropriate distance from the bath (110) so that the oxygen jet, going out of the copper nozzle (101), is able to promote the necessary mixture so that the reactions happen. During the process, the three mixed phases form an emulsion that covers part of the spear's body (100) submitting it to elevated temperatures. This emulsion projects bath particles (110) and slag (111), which can adhere either to the spear (100) as to the oven's "mouth" (105), in the form of "dross" (119).

As it can be observed in FIG. 2, the spear (100) comprises an inlet (115) for cooling liquid, an inlet for gas (116) and an outlet for cooling liquid (117), all located at spear's upper part, and the head (107). By means of the cooling liquid circulation, the spear's heat is removed (100), increasing its lifetime. Between the copper nozzle (101) and the steel tube (118), the conical tube (102) is installed, having its smaller diameter welded to the extremity (101). The tube's conical shape (102) propitiates the detachment of the adhered mixture, as there is no opposition to the gravitational force. Thus, the mixture of bath's liquid metal (110) and slag (111) adhered (dross) is detached by the action of its own weight. In addition, the thermal contraction speed difference prevents the mixture adherence to the conical tube (102). In the current invention, the increase of heat extraction promoted in the region of the conical tube (102), results in the quick contraction of the material adhered during its solidification. This way, the forming dross (119) suffers rupture and fall, due to the gravitational force. Besides the tube's conical geometry (102), the current invention proposes the copper employment in the fabrication of the conical tube (102), while a steel tube, of cylindrical geometry, is used in the state of art. The advantages of using copper reside in the fact that this metal has a thermal conductivity 5 times higher than steel, even having a lower melting point, which at first might be contradictory, as copper would melt too much sooner than steel. However, the heat absorbed by the conical tube (102) of the current invention is rapidly transmitted to the cooling liquid, not permitting that the copper melting temperature is reached, preventing that the mixture thin layer (dross) (119) remains adhered. Besides, copper is chemically stable within the oven's atmosphere, which minimizes undesirable reactions.

FIG. 3 displays the region of cleaning outlets (103). For the purpose of mouth cleaning (105), the cleaning outlets (103) are determined taking into consideration the dross forming profile (119) of each oven. The ovens are generally suspended by trunnions that permit the rotation over their shafts. The tilting direction determines two basic operations: the bath leakage (110) by the leakage channel (121) and the slag leakage (112) in the opposite direction. In function of the passage of these materials, the formation of dross (119) of mouth (105) assumes varied profiles. The cleaning outlets (103) are projected to reach regions where there is accumulation of dross (119) and avoid reaching the cleaned regions with the apparent refractories (109), thus contributing for increasing the oven's campaign (104). It is taken into consideration, for sizing of the cleaning outlets, the distance of the spear (100) to the oven (104), as well as the angles compensation taking into account the speed of the ascendant gases (112) coming from the reactions with the metallic bath (110). The possibilities or working angles at cleaning outlets (103) during the spear moves (100) inside the oven (104) vary of 170° in relation to the vertical line, making possible a minimal angle of 10° with the vertical line in the bath direction, and a minimal angle of 0° with the vertical line in the spear's head direction (107). For this purpose, the cleaning outlets (103) have a supersonic character, allowing to reach the regions of interest. However, when the purpose is maintaining the cleanliness of the cylindrical steel tube (118) located above the conical tube (102), the cleaning outlets (103) are projected to have low or sonic velocities, causing the temperature increase near the spear's upper regions (100).

FIG. 2 displays the spear set assembly (100), having on the base a copper nozzle (101) connected by the external and lower portion to the conic tube (102). Afterwards, the module with the cleaning outlets (103) is inserted. Above this module, there is the steel tube (118) and on its upper end, there is the head (107) that comprises the cooling liquid inlet (115), gases inlet (116) and cooling liquid output (117). Inside the spear (100), as it is observed in FIG. 3, two more tubes are showing: the inner tube (122), responsible for the gas passage and the intermediate tube (123), responsible for the division between the cooling liquid inlet flow and its outlet passing mandatorily through the copper nozzle (101). The tubes, inner (122) and intermediate (123), do not need to be in copper, as they are not in direct contact with the external atmosphere. The assembling of these parts is made in a tightly way. Between the intermediate tube (123) and the conical tube (102), helical fins (124) are inserted. The helical fins have the purpose of maximizing the thermal exchange at the copper conical tube (102), being its sizing variable in the number of fins, as well as in the formation angle of the helicoids. In the fabrication and assembling process, the helical fins may be fabricated directly at the external wall of the intermediate tube (123) or at the internal wall of the conical tube (102).

The cleaning outlets (103) are distributed in a copper module (125). The liquid used by the spear's refrigeration (100) has normally a turbulent flow, as it must have enough speed to not get heated reaching ebullition inside the ducts. For this purpose, the copper module (125) is projected to permit the free passage of the cooling liquid in both directions, with no losses for the flows and pressures necessary for the performance.

The invention claimed is:

1. A blowing spear for fabrication of metals and maintenance of loading and blowing operational conditions in a steel production oven in which molten steel is processed and purified, said spear comprising an inlet end comprising a steel tube and an outlet end comprising a copper nozzle, said steel tube having a cooling liquid inlet and outlet and a combustion gas inlet, a conical form tube disposed intermediate said steel tube and said nozzle, with the reduced diameter end of said conical tube being secured to said nozzle, and a plurality of cleaning outlets in communication with said combustion gas inlet disposed between said conical tube and said steel tube for emitting combustion gas for heating said spear and said oven and preventing dross formation thereon.

2. A blowing spear as defined in claim 1 in which said conical tube is formed from copper.

3. A blowing spear as defined in claim 1 in which said cleaning outlets are disposed in a copper module disposed between said conical tube and said steel tube.

4. A blowing spear as defined in claim 1 in which said cleaning outlets have working angles that vary from 0° through 170° in relation to vertical, with a minimum angle of 10° to vertical in the direction of the molten steel and a minimum angle of 0° to vertical in the direction of said inlet end.

5. A blowing spear as defined in claim 1 and including fins in said conical tube for dissipating heat.

6. A blowing spear as defined in claim 5 in which said fins are helical in shape.

* * * * *